US005785239A

United States Patent [19]

Campbell, II et al.

[11] Patent Number: 5,785,239

[45] Date of Patent: Jul. 28, 1998

[54] REDUCED MATERIAL CARTON DIVIDER AND METHOD OF PRODUCING SAME

[75] Inventors: Gordon H. Campbell, II, Marietta; John Mark Morrow, Acworth, both of Ga.

[73] Assignee: Sonoco Products Company, Hartsville, S.C.

[21] Appl. No.: 720,475

[22] Filed: Sep. 30, 1996

[51] Int. Cl.[6] ..... B65D 25/04

[52] U.S. Cl. ..... 229/120.36; 217/22; 217/34; 217/35; 220/DIG. 2

[58] Field of Search ..... 229/120.26; 217/34, 217/35, 31, 32, 33, 21, 22; 220/DIG. 2

[56] References Cited

U.S. PATENT DOCUMENTS

| | | | |
|---|---|---|---|
| 152,432 | 6/1874 | Strong | 217/31 |
| 181,371 | 8/1876 | Stevens | 217/35 |
| 200,103 | 2/1878 | Stevens | 217/31 |
| 390,735 | 10/1888 | Wieland | 217/31 |
| 848,889 | 4/1907 | Fitzgerald | 217/35 |
| 1,079,789 | 11/1913 | Merker . | |
| 1,382,787 | 6/1921 | Bombard . | |
| 1,428,594 | 9/1922 | Kainer . | |
| 1,442,280 | 1/1923 | Lorentzen . | |
| 1,448,338 | 3/1923 | Drew | 217/22 |
| 2,013,240 | 9/1935 | Harvey . | |
| 2,240,828 | 5/1941 | Behles | 217/30 |
| 2,615,749 | 10/1952 | Kuchel . | |
| 3,009,595 | 11/1961 | Bledsoe, Jr. et al. . | |
| 3,203,612 | 8/1965 | Schaefer | 229/120.36 |
| 4,793,548 | 12/1988 | Ross . | |

*Primary Examiner*—Stephen P. Garbe
*Attorney, Agent, or Firm*—Bell Seltzer Intellectual Property Law Group of Alston & Bird LLP

[57] ABSTRACT

A carton divider having vertically oriented longitudinal partitions and vertically oriented transverse partitions interengaged to form a grid of cells for receiving glass containers or the like. Adjacent cells share a wall having opposing faces, and a vertically extending reinforcing strip is mounted only on a medial portion of at least one of the opposing faces of each wall.

The reinforcing strips thus provide adequate cushioning protection for the containers to be packaged in the carton, while minimizing the amount of the material required to fabricated the partitions.

9 Claims, 3 Drawing Sheets

REDUCED MATERIAL CARTON DIVIDER AND METHOD OF PRODUCING SAME

FIELD OF THE INVENTION

The present invention relates generally to shipping cartons, and more particularly to dividers for dividing the interior of shipping cartons into cells for receiving containers.

BACKGROUND OF THE INVENTION

A common method of transporting glass containers is the corrugated cardboard carton having a divider therein for dividing the interior of the carton into cells. The carton divider is used to separate the glass containers and to protect them from breaking during transportation. Carton dividers are typically formed of chipboard, paperboard, and the like. Carton dividers typically have cell counts of 6, 8, 12, 15, 18, 24 or more. Carton dividers of this general type are shown, for example, in U.S. Pat. Nos. 3,942,709; 3,948,435 and 4,094,454.

Carton dividers accomplish their function of preventing breakage by absorbing and dissipating the kinetic energy of the individual glass containers during transportation. The carton divider material prevents the glass bottles from breaking because this energy is not passed along to the adjacent bottle. The thickness of the material used to form a carton divider may vary depending on the size and weight of the glass containers being packed. The more common material is paperboard, and the thicknesses used in carton dividers are typically: 0.030", 0.040", 0.047", and 0.055". This is based on an industry standard density of approximately 3 pounds per thousandths of an inch per one thousand square feet (lbs/pt/msf) of material.

As a result of competitive pressures, glass container manufacturers are generally seeking ways to reduce packaging costs or to find less expensive packaging alternatives. By reducing the amount of material in a carton divider, glass container manufacturers can save considerable costs. Unfortunately, the tradeoff often is an increase in the amount of glass breakage. By changing the general design of the conventional carton divider, glass container manufacturers may be forced to install different and costly equipment. In addition, a change in design may interfere with existing automatic packing and unpacking practices.

SUMMARY OF THE INVENTION

It is therefore an object of the present invention to reduce the cost of producing conventional carton dividers used for packaging glass containers without sacrificing the degree of protection for the glass containers packed therewithin.

It is another object of the present invention to produce a lower cost carton divider that allows glass container manufacturers to use existing automatic equipment for the erection and insertion of carton dividers within shipping cartons.

It is another object of the present invention to produce a lower cost carton divider that does not interfere with existing practices of automatically packing and unpacking glass containers.

These and other objects are accomplished, according to the present invention, by a carton divider that divides the interior of a carton into cells for receiving glass containers and the like. The carton divider includes at least one vertically oriented longitudinal partition, and at least one separate vertically oriented transverse partition intersecting each longitudinal partition and cooperating therewith to define a plurality of cells for receiving containers. The cells have cell walls defined by the intersecting longitudinal and transverse partitions, and each one of the cell walls has opposing faces. The cell walls serve to separate adjacent containers from contact with one another. Each longitudinal partition has longitudinally spaced apart vertically extending slots formed therein and arranged for receiving a corresponding transverse partition. Each transverse partition has transversely spaced apart vertically extending slots therein arranged for cooperating with and receiving corresponding slots in the longitudinal partitions.

A vertically extending reinforcing strip, having a typical thickness of from about 0.015 to 0.025 inches, is adhesively secured to a medial portion of at least one of the opposing faces of each of the cell walls. Each reinforcing strip extends laterally on opposite sides of a vertical line bisecting the cell wall face and extends vertically for a distance spanning the vertical extent of the cell wall face. Each reinforcing strip typically has a lateral width equal to between about one third and about one half the lateral width of the cell wall face and this lateral width may vary depending upon the diameter of the glass containers being packaged.

The combined thickness of each transverse partition and reinforcing strip is typically at least about 0.030 inches. Similarly, the combined thickness of each longitudinal partition and reinforcing strip is typically at least about 0.030 inches. The reinforcing strips and longitudinal and transverse partitions may be made from paperboard or chipboard or other materials including foams, etc.

According to another aspect of the present invention, a method of producing the carton divider described above is provided. A substrate is advanced along a longitudinal direction, and a plurality of longitudinally extending, laterally spaced apart reinforcing strips are adhesively secured thereto. The advancing substrate undergoes slitting operations to provide a plurality of partitions having slots therein, wherein the slots are arranged for receiving a corresponding transversely oriented partition. The partitions undergo an interlocking operation wherein the slits therein are interengaged to form a grid of cells for receiving containers.

The present invention is advantageous because there is a significant reduction in material needed for a given carton divider, thereby resulting in considerable cost savings while providing the same level of protection afforded by carton dividers using conventional amounts of material. The present invention is also advantageous in that users of the carton divider may continue to use existing automatic equipment for the erection and insertion of partitions. Furthermore, the present invention does not interfere with the standard practices of automatically packing and unpacking glass.

DETAILED DESCRIPTION OF PREFERRED EMBODIMENTS

The present invention now is described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Figure 1:
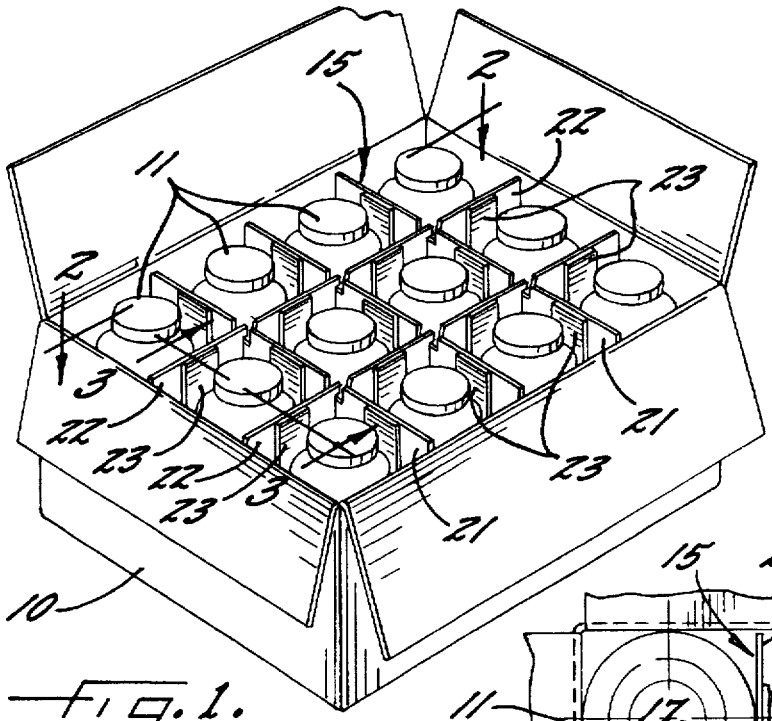
FIG. 1 is a perspective view showing a carton in which there is provided a carton divider constructed in accordance with the present invention.
Figure 2:
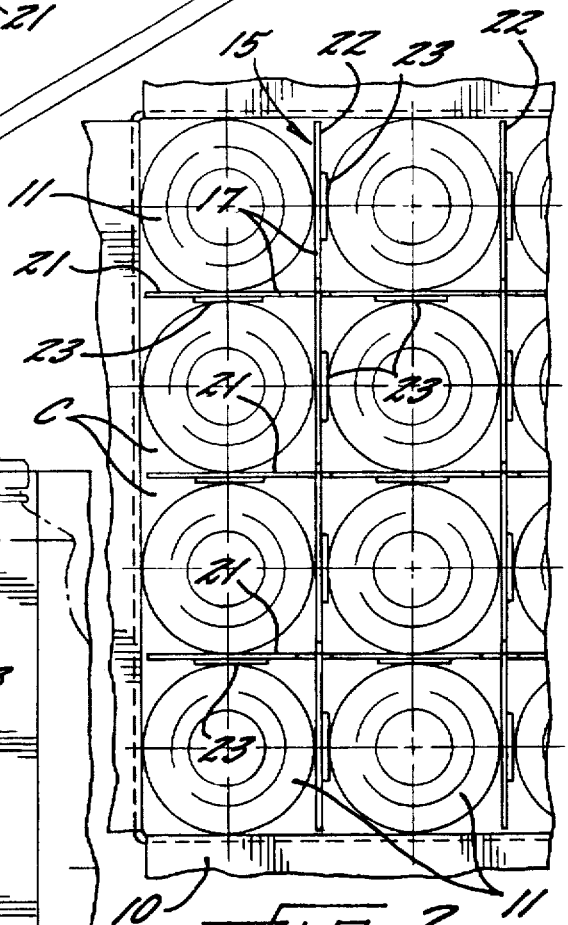
FIG. 2 is a top plan view of the carton and carton divider taken along lines 2—2 in FIG. 1.
Figure 3:
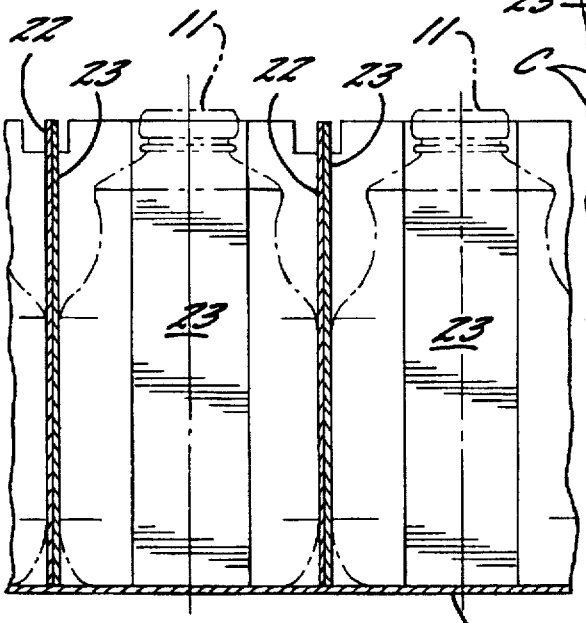
FIG. 3 is a cross-sectional view taken along lines 3—3 in FIG. 1.

Referring now to FIGS. 1–3, there is shown a carton 10 formed of corrugated cardboard which contains a plurality of containers 11, shown in the form of glass jars. A carton divider 15, constructed in accordance with the present invention, serves to divide the carton into a plurality of individual cells C having walls 17, each cell having a size adapted to accommodate the respective containers 11 (FIG. 2). The cell walls 17 of the carton divider 15 separate the containers 11 and keep them out of contact with one another during shipment, and thereby prevent breakage of the containers (FIG. 3). Adjacent cells C share a wall 17 defined by either a longitudinal or transverse partition, the wall having opposing faces (one for each respective cell) as illustrated. As described in greater detail below, a reinforcing strip 23 is secured to at least one of the opposing faces of a wall 17 separating adjacent cells C. The present invention permits carton dividers having virtually any number of cells C, for example: 8, 12, 15, 18, 24, and more. Furthermore, the carton divider 15 of the present invention is collapsible after assembly, thus enabling delivery of the carton divider in a pre-assembled form.

Figure 4:
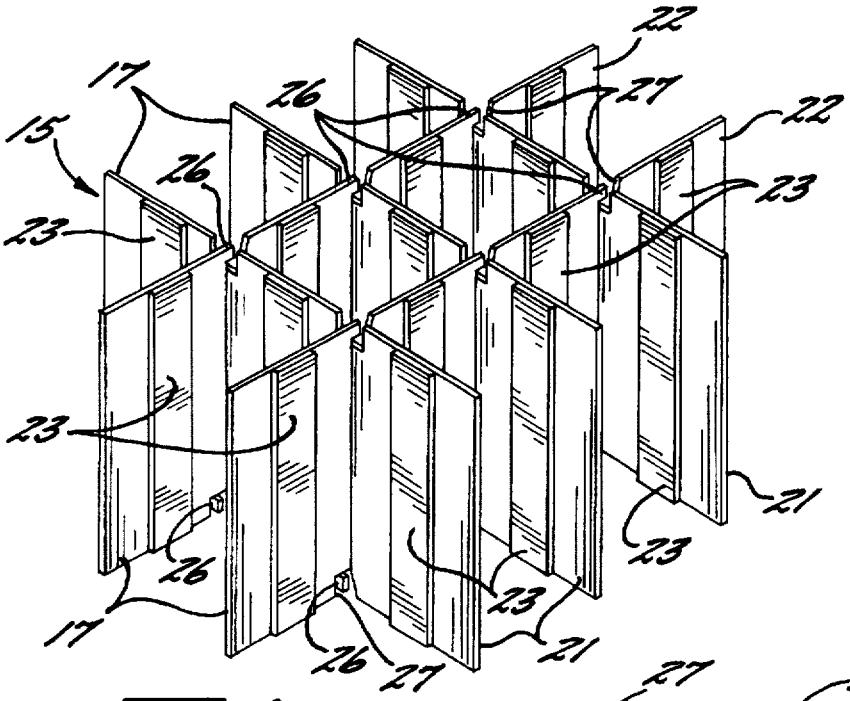
FIG. 4 is a perspective view of a carton divider constructed in accordance with the present invention.
Figure 5:
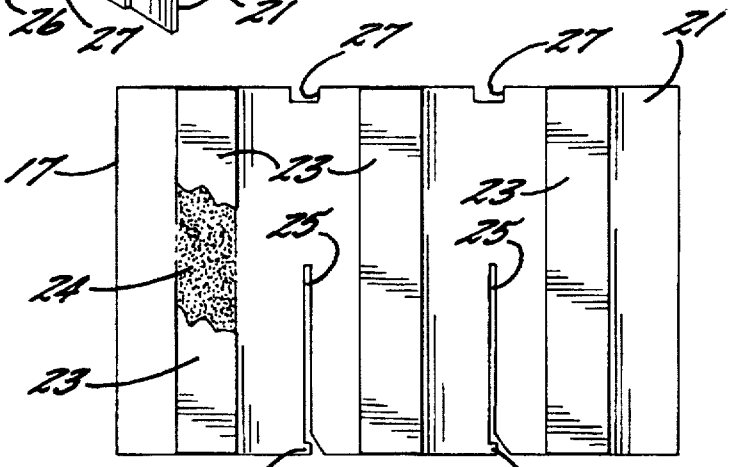
FIG. 5 is a transverse partition used for forming a carton divider according to the present invention.
Figure 6:
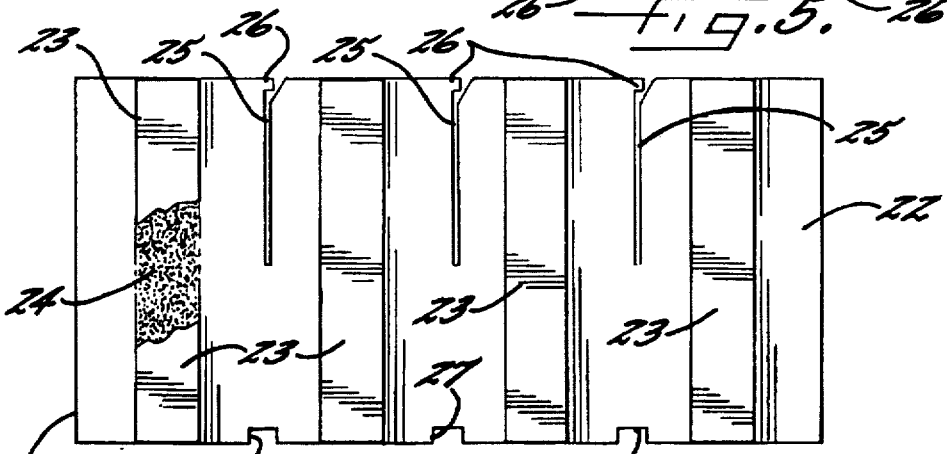
FIG. 6 is a longitudinal partition used for forming a carton divider according to the present invention.

Referring now to FIGS. 4–6, the illustrated carton divider 15 includes a plurality of longitudinal partitions 22 extending in laterally spaced apart relationship, and a plurality of transverse partitions 21 extending in laterally spaced apart relationship. The transverse and longitudinal partitions 21, 22 intersect to form a series of cells C for receiving containers 11, as illustrated in FIGS. 1–3. The partitions 21, 22 are typically formed of chipboard, paperboard or other suitable material. As with any conventional carton divider, the partitions 21 and 22 are formed with vertically extending spaced apart slots 25 which allow the partitions to be assembled together in intersecting relation (FIGS. 5–6). In the illustrated embodiment, a locking tab 26 is provided adjacent the open end portion of each slot 25. Locking tab 26 engages a respective slot 27 in a respective intersecting partition. For example, as illustrated in FIG. 4, along the top portion of the carton divider 15, locking tabs 26 of longitudinal partitions 22 engage slots 27 of transverse partitions 21 and prevent the partitions from becoming easily disengaged. Similarly, along the bottom portion of carton divider 15, locking tabs 26 of transverse partitions 21 engage slots 27 of longitudinal partitions 22 and also prevent the partitions from becoming easily disengaged.

In the illustrated embodiment, a plurality of reinforcing strips 23 are secured to each partition 22 and 21 in spaced apart relationship in a direction transverse to the longitudinal direction of each partition. Preferably, each reinforcing strip 23 is formed of paperboard having a thickness of about the same thickness as the partition to which it is secured. In the illustrated embodiment, each reinforcing strip 23 is secured to a respective partition 21, 22 via an adhesive 24. Preferably each reinforcing strip 23 is secured to each partition 22 and 21 so as to be centered on each respective cell wall 17, as illustrated in FIG. 4. It is preferred that each reinforcing strip 23 extend equally on opposite sides of a vertical line bisecting the face of a respective cell wall 17 to which it is secured. Preferably, each reinforcing strip 23 also extends the entire width of the face of each cell wall 17, as illustrated, so as to have a vertical orientation parallel with the vertical orientation of each container 11. Because the reinforcing strips 23 of the present invention are secured to each partition with a vertical orientation, they have less potential for causing label damage or packing and unpacking problems as reinforcing strips running in a horizontal direction would.

The reinforcing strips 23 may vary in width, thickness, and height depending on the diameter and weight of the glass container or other article to be secured within each cell C. Furthermore, it is preferred that the number of reinforcing strips 23 provided in a cell ensures that each glass container 11 is protected with the appropriate paper thickness on all sides including containers adjacent the sides of the corrugated container 10. The thickness of each reinforcing strip 23 is selected so that the combined thickness of a partition 21,22 and a respective reinforcing strip 23 secured thereto is equivalent to the current industry standards for a particular glass container. For example, if industry standards call for a partition thickness of 0.0401" between adjacent glass containers, a partition having a thickness of 0.020" used in conjunction with a reinforcing strip having a thickness of 0.020" would be acceptable. Furthermore, any number of thickness combinations may be employed to meet industry standards without departing from the spirit and intent of the present invention.

The present invention utilizes a significant reduction in material for a given carton divider 15, thereby resulting in considerable cost savings while providing the same level of protection afforded by carton dividers using conventional amounts of material. The present invention is advantageous in that users of the carton divider 15 may use existing automatic equipment for the erection and insertion of partitions. Furthermore, the present invention does not interfere with the standard practices of automatically packing and unpacking glass.

Figure 7:
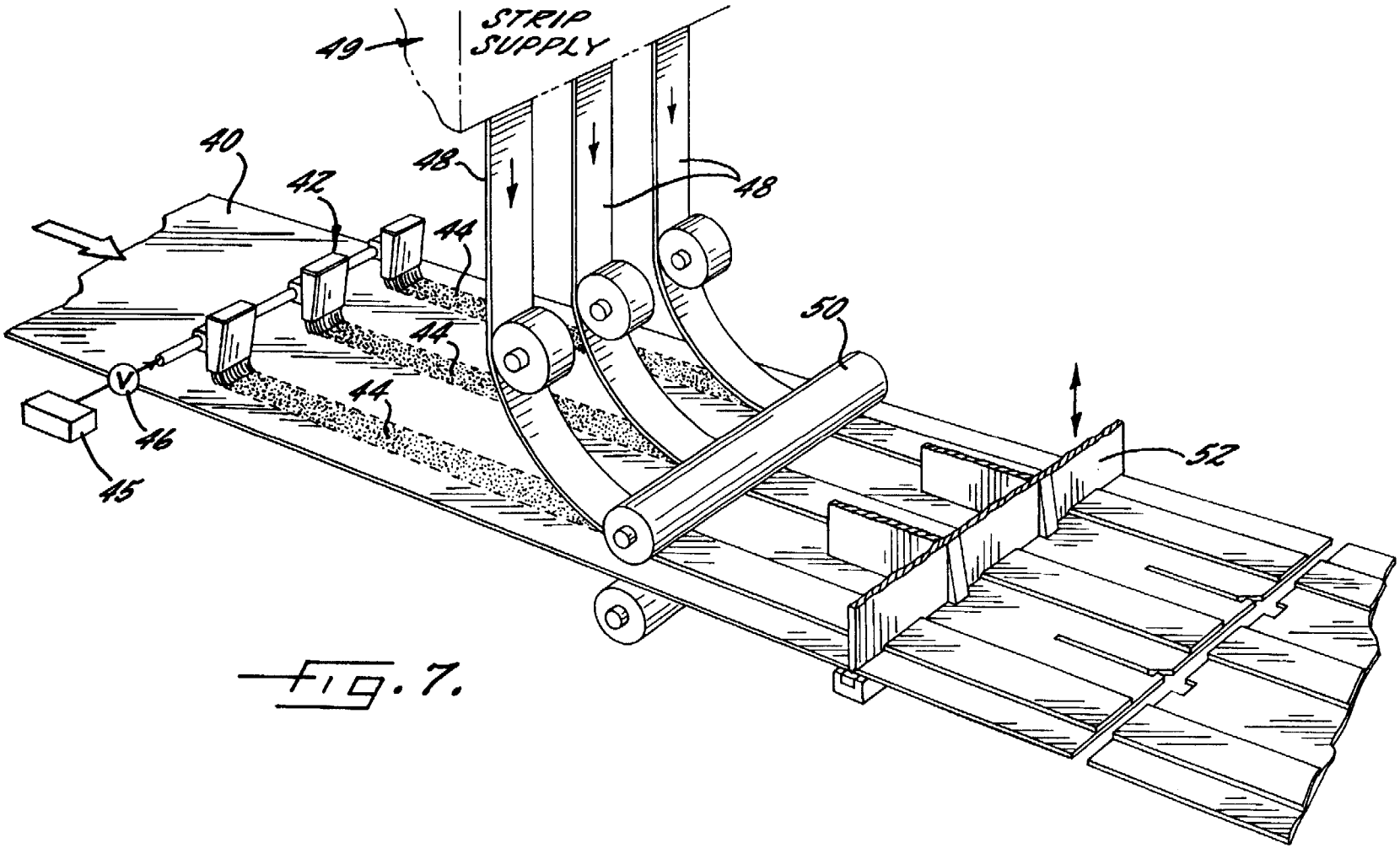
FIG. 7 illustrates a method of forming transverse and longitudinal partitions according to the present invention.

Referring now to FIG. 7, a method of manufacturing a carton divider 15 according to the present invention is illustrated. A paperboard substrate 40 is advanced beneath a series of applicators 42 which apply a plurality of laterally spaced apart layers of adhesive 44 to the substrate 40. As illustrated schematically, adhesive may be provided from reservoir 45 and controlled via valve(s) 46. Downstream from applicators 42, a plurality of reinforcing strips of paperboard 48 are advanced from paperboard supply 49 and secured to the advancing substrate 40 via a respective adhesive layer 44.

Rollers 50 subject reinforcing strips 48 and substrate 40 to compressive forces to facilitate adhesion of the reinforcing strips to the substrate. Preferably, the substrate 40 is under tension prior to the application of the adhesive and during compression via rollers 50. The advancing substrate 40 and the reinforcing strips of paperboard 48 are preferably advanced at the same rate of speed.

A cut-off knife 52 cuts the advancing substrate 40 into individual partitions with appropriately configured and located slots as illustrated. In addition, as would be understood by those having skill in the art, separate operations may be performed for cutting the substrate into partitions and for producing slots therein. Furthermore, the substrate 40 may be cut to produce the slots and the appropriate size of each partition prior to the application of adhesive 44 and reinforcing strips 48. Separate operations may also be provided for interengaging longitudinal and transverse partitions into carton dividers.

The width of substrate 40 is varied depending on whether longitudinal partitions or transverse partitions, as described above, are being produced. Alternatively, separate operations may be utilized for producing longitudinal and transverse partitions.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed:

1. A carton divider for dividing the interior of a carton into cells for receiving containers, comprising:

at least one vertically oriented longitudinal partition;

at least one separate vertically oriented transverse partition intersecting said longitudinal partition and cooperating therewith to define a plurality of cells for receiving containers, the cells having cell walls defined by the intersecting longitudinal and transverse partitions serving to separate adjacent containers from contact with one another, each one of said cell walls having opposing faces;

a vertically extending reinforcing strip mounted on a medial portion of at least one of said opposing faces of each of said cell walls; and said reinforcing strip and said longitudinal and transverse partitions each comprise paperboard or chipboard.

2. A carton divider according to claim 1 wherein each reinforcing strip extends laterally on opposite sides of a vertical line bisecting said cell wall face and extends vertically for a distance spanning the vertical extent of said cell wall face.

3. A carton divider according to claim 2 wherein each reinforcing strip has a lateral width equal to between about one third and about one half the lateral width of the cell wall face.

4. A carton divider according to claim 1 wherein the combined thickness of each transverse partition and reinforcing strip is at least about 0.030 inches.

5. A carton divider according to claim 4 wherein the combined thickness of each longitudinal partition and reinforcing strip is at least about 0.030 inches.

6. A carton divider according to claim 1 wherein said reinforcing strip has a thickness of at least about 0.015 inches.

7. A carton divider for dividing the interior of a carton into cells for receiving containers, comprising:

a plurality of vertically oriented longitudinal partitions, each having longitudinally spaced apart vertically extending slots formed therein and arranged for receiving a corresponding transverse portion;

a plurality of separate vertically oriented transverse partitions each having transversely spaced apart vertically extending slots therein arranged for cooperating with and receiving corresponding slots In the longitudinal partitions;

said longitudinal partitions and said transverse partitions being assembled with the respective slots thereof disposed in intersecting relationship to form a grid of cells for receiving containers, the cells having cell walls defined by the intersecting longitudinal and transverse partitions serving to separate adjacent containers from contact with one another, each one of said cell walls having opposing faces;

a vertically extending reinforcing strip mounted on a medial portion of at least one of said opposing faces of each of said cell walls, wherein each reinforcing strip extends laterally on opposite sides of a vertical line bisecting said cell wall face and extends vertically for a distance spanning the vertical extent of said cell wall face;

said reinforcing strip and said longitudinal and transverse partitions each comprise paperboard or chipboard.

8. A carton divider according to claim 7 wherein each reinforcing strip has a lateral width equal to between about one third and about one half the lateral width of the cell wall face.

9. A carton divider according to claim 7 wherein each reinforcing strip is adhesively secured to the associated cell wall face.

* * * * *

UNITED STATES PATENT AND TRADEMARK OFFICE
CERTIFICATE OF CORRECTION

PATENT NO. : 5,785,239

DATED : July 28, 1998

INVENTOR(S) : Campbell et al.

It is certified that error appears in the above-identified patent and that said Letters Patent is hereby corrected as shown below:

Column 6, line 12, "portion" should be --partition--; line 16, "In" should be --in--.

Signed and Sealed this

Third Day of November, 1998

*Attest:*

*Attesting Officer*

Bruce Lehman

BRUCE LEHMAN

*Commissioner of Patents and Trademarks*